US005974800A

United States Patent [19]

Scheidl et al.

[11] Patent Number: 5,974,800

[45] Date of Patent: Nov. 2, 1999

[54] DEVICE FOR ACTUATING A HYDROSTATIC DRIVE

[75] Inventors: Rudolf Scheidl, Erlauf; Werner Leitner, Linz; Gerald Riha, Leonding; Dietmar Schindler, Edt/Lambach, all of Austria

[73] Assignee: Mannesmann Rexroth AG, Lohr am Main, Germany

[21] Appl. No.: 08/894,494

[22] PCT Filed: Jan. 31, 1996

[86] PCT No.: PCT/AT96/00015

§ 371 Date: Aug. 1, 1997

§ 102(e) Date: Aug. 1, 1997

[87] PCT Pub. No.: WO96/23980

PCT Pub. Date: Aug. 8, 1996

[30] Foreign Application Priority Data

Feb. 1, 1995 [AT] Austria ..... A 169/95

[51] Int. Cl.[6] ..... F15B 21/04

[52] U.S. Cl. ..... 60/532; 91/419

[58] Field of Search ..... 60/532, 328, 329; 91/419, 459, 460

[56] References Cited

U.S. PATENT DOCUMENTS

| | | | |
|---|---|---|---|
| 3,020,720 | 2/1962 | Spalding | 60/532 |
| 3,541,782 | 11/1970 | Shatto, Jr. | 60/532 |
| 3,741,073 | 6/1973 | Garnjost | 91/363 A |
| 3,835,810 | 9/1974 | Hughes . | |
| 5,136,926 | 8/1992 | Bies et al. | 60/459 X |

FOREIGN PATENT DOCUMENTS

| | | |
|---|---|---|
| 661144 | 7/1965 | Belgium . |
| 0006833 | 1/1980 | European Pat. Off. . |
| 2931797 | 2/1981 | Germany . |
| 3314392 | 10/1984 | Germany . |

OTHER PUBLICATIONS

Energie Fluide, vol. 14, No. 83, Dec. 1975, Paris, France, pp. 28–32, XP002008512 le generateur hydraulique d'impulsions au service du formage de metaux.

*Primary Examiner*—John Ryznic
*Attorney, Agent, or Firm*—Martin A. Farber

[57] ABSTRACT

A device for the operation of a hydrostatic drive (1) having a periodically operable switch valve (2) which connects a resonant pipe (4) connected with the hydrostatic drive (1) for the formation of standing pressure waves in the hydraulic fluid under resonant conditions alternately to a pressure-fluid supply line (5) and to a return line (6). In order to create advantageous control condition, the resonant pipe (4) has a pressure outlet (7) in an oscillation node in the standing pressure waves, and that the switch times of the switch valve (2) be controllable with constant switch frequency.

12 Claims, 3 Drawing Sheets

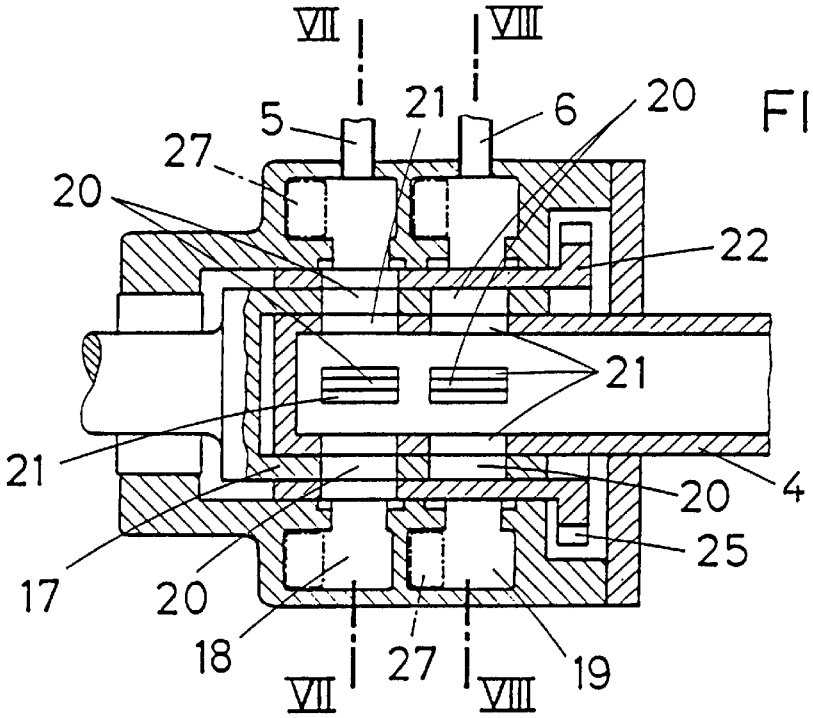
FIG.6
FIG.7
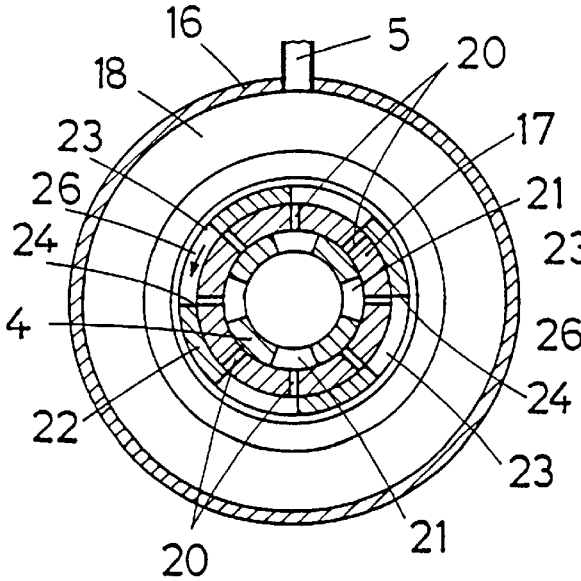
FIG.8
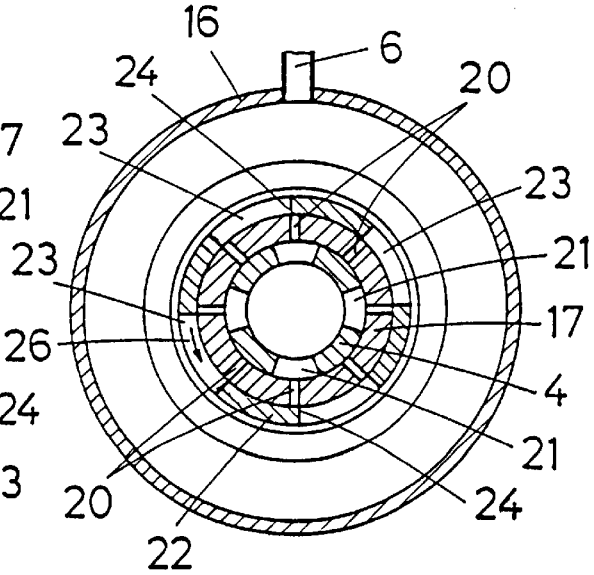

DEVICE FOR ACTUATING A HYDROSTATIC DRIVE

FIELD AND BACKGROUND OF THE INVENTION

The invention relates to a device for actuating a hydrostatic drive with a periodically operable switch valve which connects a resonant pipe connected to the hydrostatic drive for the generating of standing pressure waves in the hydraulic fluid under resonant conditions alternately to a pressure supply line and a return line.

In order to avoid the disadvantages of throttle-controlled hydrostatic drives, particularly the throttle losses, it is known to connect the drive not continuously via a throttle valve but periodically to a hydraulic fluid supply line or a return line, namely via switch valves, to each of which a non-return valve is connected in parallel. The opening of the switch valve in the hydraulic fluid supply line causes an accelerating of the drive, the inertia of which upon the closing of this switch valve leads to a reduction in the pressure of the compressible hydraulic fluid in the drive range to a pressure which is less than the closing pressure of the non-return valve in the region of the return line, so that hydraulic fluid can be drawn in via the return line until the switch valve in the supply line again opens and the process is repeated. In the case of a regenerative braking of the drive, there is obtained, upon the closing of the switch valve in the return line, an increase in the pressure of the drive-side hydraulic fluid to an amount exceeding the closing pressure of the non-return valve in the region of the supply line, which results in a pumping of the hydraulic fluid back into the supply line. This additional flow of hydraulic fluid caused by the pulsed actuation of the drive causes a corresponding recovery of energy and thus an improved efficiency which, to be sure, is obtained at the cost of a comparatively small dynamics and a corresponding structural expense.

If the development of standing pressure waves in the hydraulic fluid under resonant conditions is assured in a resonant pipe connected in front of a hydrostatic drive in the manner that the resonant pipe is connected via a switch valve actuated with a corresponding resonant frequency alternately to a hydraulic fluid supply line and a return line, then, with such pulsed actuations there is obtained a simple storing of energy during the pressure-pulse pauses, as has been shown by fundamental examinations. To be sure, these known examinations still do not provide any solution for the technical use of this resonant pipe upon the pulsed actuation of hydrostatic drives since, with the operating path of these drives, the resonant conditions for the development of the standing pressure waves change and therefore the resonant conditions cannot be maintained.

SUMMARY OF THE INVENTION

The object of the invention therefore is to develop a device for the control of a hydrostatic drive of the aforementioned type by simple structural means in such a manner that the operating pressure for the drive can be adjusted independently of its operating path between the maximum pressure offered via the hydraulic fluid supply line and the pressure of the return line, and this with a high efficiency and good dynamics.

According to the inventin the resonant pipe has a pressure outlet in an oscillation node of the standing pressure waves, and that the switch times of the switch valve can be controlled with constant switch frequency.

By the provision of a pressure outlet in an oscillation node of the standing pressure waves which are formed in the resonant pipe, an operating pressure for the drive can first of all be made available in this pressure outlet without influencing the resonant conditions by the operating path of the drive. The stationary reflection end for the pressure waves is not formed by the drive, as is the case upon connection of the drive to the end of the resonant pipe. In addition to this, due to the arrangement of the pressure outlet in an oscillation node of the pressure waves, the pressure waves of the orders associated with this nodal point can be suppressed at the pressure outlet, so that, despite a pulsed actuation the pulsation time of the operating pressure at the pressure outlet is comparatively slight. While maintaining the resonant conditions, there is furthermore established a good dynamic behavior since, due to the dependence of the average operating pressure on the size of the pressure pulses, an operating-pressure adjustment requires merely a corresponding adjustment of the switch times of the switch valve. The additional structural expense is limited essentially to the provision of a suitable resonant pipe, the length of which must be selected as a function of the length of the pressure waves forming in the hydraulic fluid, so that, with a switch frequency equal to the integral multiple of that frequency which corresponds to twice the propagation time of the pressure waves over the resonant pipe, standing pressure waves are formed.

In order, in addition, to reduce the pulsation time of the working pressure made available to the drive, it can be provided, as a further development of the invention, that the resonant pipe connected to the control valve forms a main resonator, adjoining the pressure outlet of which there is at least one secondary resonator having a resonant pipe which again has a pressure outlet in an oscillation node of the standing pressure waves formed in this resonant pipe, and that the resonant pipe of the main resonator can either be connected in parallel to an additional resonant pipe or can be connected at both ends via oppositely operable switch valves with the pressure-fluid supply line and the return line. With the aid of the secondary resonator, pressure waves of a higher order can be suppressed, which makes itself noticeable by a corresponding smoothing of the variations in the operating pressure on the pressure outlet of the secondary resonator. In the case of a simple pipe branching, the pressure variations are unstable. For the desired resonance behavior therefore, corresponding limit conditions must be created. For his purpose, there can be connected in parallel to the resonant pipe of the main resonator an additional resonant pipe which brings about the required resonant conditions for the main resonator. Another possibility consists therein that, via a switch valve which is actuatable in opposite direction to the inlet-side switch valve, a fixed reflection end for it is provided at the other end of the resonant pipe.

If at least two secondary resonators are provided, they are to be connected to the respective pressure outlets of the preceding resonator and be formed, with exception of the outlet-side secondary resonance, of a parallel circuit of at least two resonant pipes one of which has the pressure outlet for the connection of the following resonator, so that also in the region of the secondary resonators, the resonant conditions for the pressure waves developed in the resonant pipes thereof can be maintained. With each additional secondary resonator, pressure waves of correspondingly higher order can be suppressed, so that the remaining residual ripple can be adapted to the corresponding tolerance ranges.

The opposite arrangement in space of the parallel-connected resonant pipes plays no role in the manner of action of this parallel circuit. The parallel-connected resonant pipes can therefore be arranged in accordance with the space available. Particularly simple, space-saving structural conditions result in this connection if the parallel-connected resonant pipes surround each other coaxially.

As already stated, the precise maintaining of the resonant conditions is of considerable importance for the efficiency. In order to achieve an adaptation to the factors of influence which change during operation, for instance the temperature-dependent viscosity and compressibility of the hydraulic fluid, a closed-loop control device can be associated with the switch valve for adjusting the switch frequency to the in any event changing resonant frequency of the resonator connected directly to the control valve. For this purpose, there can be established for the main resonator a desired pressure value determined for a given measurement point for a given position of the switch valve, which value is compared with the actual pressure determined at this measurement point in the corresponding position of the switch valve, so that any difference between desired and actual values which may occur can be compensated for by a shifting of the switch frequency of the switch valve. Another possibility consists in monitoring the position of an oscillation node of the standing pressure waves. A change in the resonant frequency results, with the same switch frequency of the switch valve, in a displacement of the nodal point so that pressure variations are detected at the original nodal points, which variations can be used by a control of the switch frequency of the switch valve for adaptation to the resonant frequency.

The switch valve must assure the comparatively high switch frequencies for the maintaining of the resonant frequencies, namely in the case of pressure pulses with flanks which are as steep as possible. In order to satisfy these requirements, it is proposed, in a further development of the invention, to develop the switch valve as a rotary piston valve with a rotary piston which coaxially surrounds the resonant pipe, which piston passes, within a housing, through annular chambers arranged axially one behind the other which are connected on the one hand to the hydraulic fluid supply line and on the other hand to the return line, and has, in the region of these annular chambers, passage openings forming control edges which cooperate with passage openings of the resonant pipe, the release of which passage openings can be controlled by a rotatable control sleeve with control edges for the switch times. The speed of rotation of this rotary piston valve determines the switch frequency of the switch valve, so that the switch frequency can be controlled in very simple fashion via the rotary drive. The rotary piston opens and closes the passage openings of the resonant pipe alternately in the region of the two housing chambers, in which connection the switch times can additionally be set by the control sleeve which is mounted rotatable with respect to the resonant pipe and, via its control edges, releases the passage openings in the resonant pipe earlier or later. By means of this control sleeve, the pressure pulse width and thus the operating pressure desired in each case can be easily set.

In order that a control of the drive can be assured under pressure conditions which are as constant as possible in the region of the switch valve despite the comparatively high switch frequencies, it is advisable to see to a corresponding hydraulic capacity, which can be achieved by pressure-elastic bodies as close as possible to the switch valve. For this purpose, such pressure-elastic bodies, preferably hoses filled with a pressurized gas, can be provided in the annular chambers of the housing of the switch valve. Instead of the hoses filled with a pressurized gas, pressure chambers covered by a membrane can also be used.

By the liquid friction there result, within the resonant pipes losses which result in a reduction in the efficiency. The friction losses which occur as a result of relative movement between the hydraulic fluid and the pipe body can be substantially suppressed if the body of the resonant pipe or pipes is developed orthotropic with a stiffness in circumferential direction greater than in axial direction. The lesser axial stiffness of the pipe body permits it to be carried along by the hydraulic fluid and thus a reduction in the frictional losses. To be sure, upon the use of such orthotropic pipes, a non-displaceable attachment of the pipe ends must be assured.

In order to obtain the required orthotropic properties, the body of the resonant pipe or pipes can consist of a corrugated pipe. However, it is also possible to produce plastic pipes in corresponding orthotropic fashion, in which case, however, it is to be seen to it that the dissipation in the pipe body itself remains as small as possible. In order to utilize the orthotropy for the reduction in friction, the elastic behavior of the pipe body in circumferential and lengthwise directions can furthermore be so adapted to each other that as a result of a circumferential extension caused by the liquid pressure and the shortening transverse thereto which is caused thereby, a corresponding change in length in the pipe body is established. If the negative extension in length of the pipe body in the case of a given hydraulic fluid pressure corresponds to the liquid compression, then no relative movement takes place between hydraulic fluid and pipe body.

BRIEF DESCRIPTION OF THE DRAWINGS

With the above and other objects and advantages in view, the present invention will become more clearly understood in connection with the detailed description of preferred embodiments, when considered with the accompanying drawings of which:

FIG. 6 is a simplified axial section through a switch valve;

FIG. 7 is a section along the line VII—VII of FIG. 6; and

FIG. 8 is a section along the line VIII—VIII of FIG. 6.

DETAILED DESCRIPTION OF THE PREFERRED EMBODIMENTS

Figure 1:
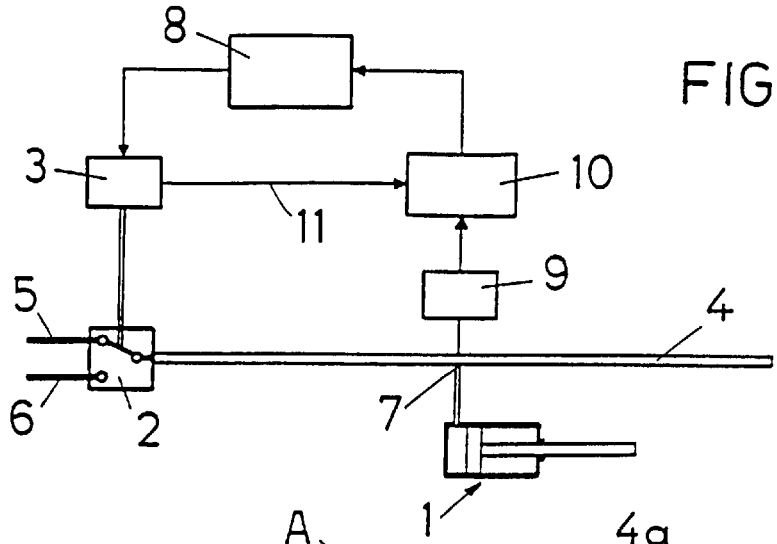
FIG. 1 shows a device in accordance with the invention for controlling a hydrostatic drive, in a simple block diagram.

The device for controlling a hydrostatic drive 1 which is indicated as work cylinder has an switch valve 2 which is moved periodically via a suitable drive 3. This switch valve 2 connects a resonant pipe 4 optionally with a hydraulic fluid supply line 5 and a return line 6 to a pressurized hydraulic fluid tank. The length of the resonant pipe 4 corresponds to a whole-number multiple of the wavelength of the pressure waves of the hydraulic fluid which are formed in the resonant pipe 4 and which propagate over the length of the resonant pipe 4 as a result of the pressure pulses resulting from the actuating of the switch valve. Since the resonant pipe 4 furthermore forms a fixed reflection end for these pressure waves, there are produced under resonant condition in the resonant pipe 4, standing pressure waves of different order with oscillation nodes in which the pressure waves passing through these nodal points have no amplitude so that by a pressure outlet 7 in the region of such a nodal point, the pressure waves associated with it are suppressed and the drive 1 connected to this pressure outlet 7 is acted on by an operating pressure which is subjected to correspondingly smaller variations. The operating path of the drive 1 connected to the pressure outlet 7 has no effect on the resonant conditions in the resonant pipe 4, which creates simple control conditions since, over the switch times of the switch valve 2 which determine the pressure pulse width, with a switch frequency adapted to the resonant frequency, the effective value of the working pressure at the pressure outlet 7 can be adjusted as desired between a maximum pressure corresponding to the pressure in the hydraulic fluid supply line 5 and a minimum pressure corresponding to the pressure in the return line 6.

The factors of influence on the resonant conditions can, however, not always be considered constant. Thus, for instance, the viscosity and the compressibility of the hydraulic fluid change with the temperature which is subject to variations so that the device must be adapted to the changing resonant conditions if the highest possible efficiency is desired. This adaptation can be effected comparatively easily by an adjustment of the switch frequency of the switch valve 2, as indicated diagrammatically in FIG. 1. For this purpose, the drive 3 for the switch valve 2 is controlled via a control device 8 which monitors any possible displacement of an oscillation node. By means of a pressure transducer 9 connected to the resonant pipe 4 in the region of the nodal point and of a band filter 10 adapted to the frequency of the pressure waves traveling through the nodal point, the pressure amplitudes of the pressure waves associated with the oscillation node which occur upon displacements of oscillation nodes at the predetermined nodal point can be detected and used to control the switch-valve drive 3 so as to adjust the switch frequency to the resonant frequency. The band filter 10 can be adapted to the corresponding switch frequency of the switch valve, as is shown in FIG. 1 by a control line 11 between the switch-valve drive 3 and the band filter 10.

Figure 2:
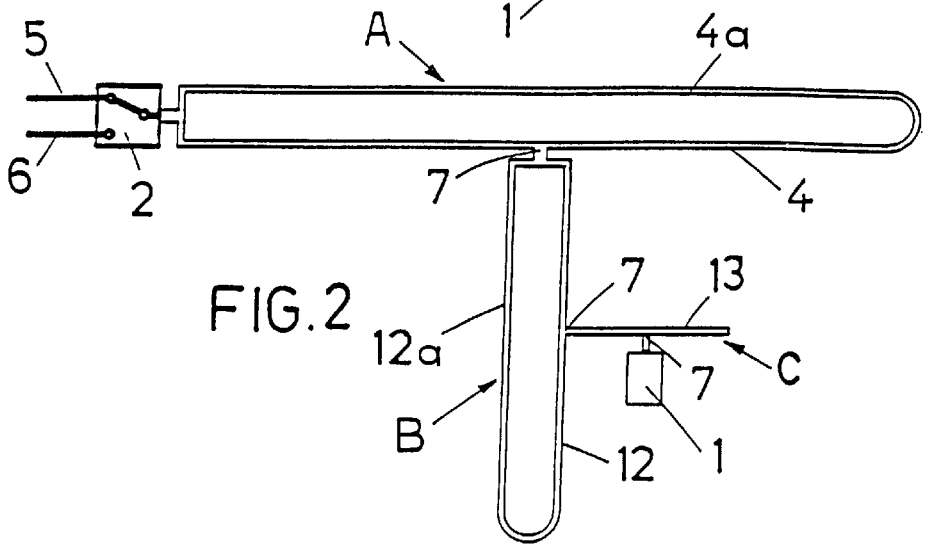
FIG. 2 is a block diagram of a device in accordance with the invention having a main resonator and two secondary resonators.
Figure 3:
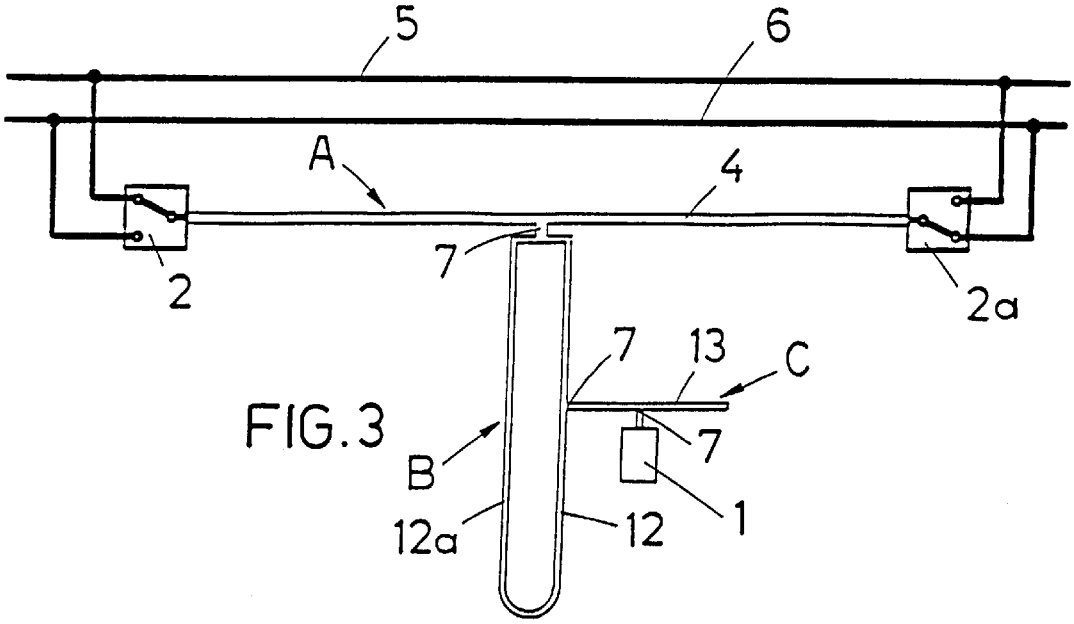
FIG. 3 is a structural variant of a device corresponding to FIG. 2.
Figure 4:
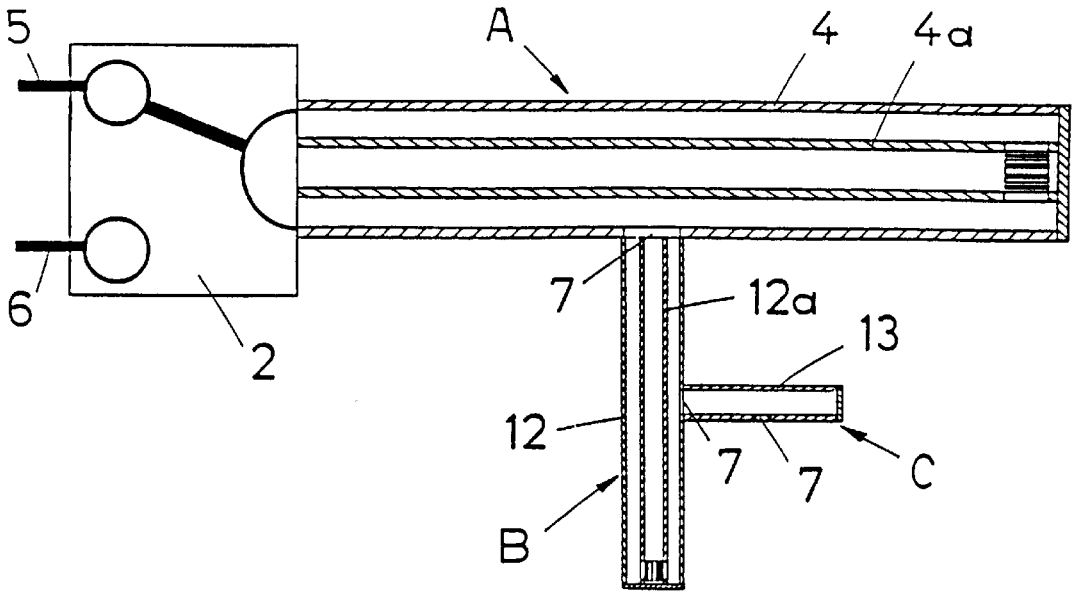
FIG. 4 is another embodiment of a device in accordance with the invention.

Although fundamentally the pressure outlet 7 can be arranged in the region of oscillation nodes of pressure waves of higher order, in general particularly favorable conditions are present in the region of an oscillation node of the fundamental wave of the pressure oscillations, and therefore in the longitudinal center of the resonant pipe 4. In this case, the fundamental wave and the pressure harmonic waves of an odd order number are suppressed at the pressure outlet 7. If further harmonics are to be suppressed, an additional resonant pipe 12 and possibly in further sequence additional resonance pipes 13 can be connected to the pressure outlet 7 of the resonant pipe 4, namely in each case to the pressure outlet 7 of the resonant pipe of the directly preceding order. With a central arrangement of the pressure outlet 7, each of the resonant pipes is developed with half the length of the resonant pipe in front of it, as shown in FIGS. 2 to 4. In this way, the pressure harmonics of orders 2, 6, 10, etc. are suppressed at the resonant pipe 12 and the pressure harmonics of orders 4, 12, 20, etc. are suppressed at the pressure outlet 7 of the resonant pipe 13, so that the residual variations of the operating pressure at the pressure outlet 7 of the resonant pipe 13 are comparatively small. If necessary, this residual pulsation can be further reduced by the adding of additional resonant pipes.

The use of additional resonant pipes is to be sure possible only if, despite the branchings formed by the connected resonant pipes, the resonant conditions in the prior resonant pipe are not impaired. This is achieved, in accordance with FIG. 2, in the manner that a resonant pipe 4*a* is connected in parallel to the resonant pipe 4 so that this parallel connection of the resonant pipes 4 and 4*a* results in a main resonator A. In similar manner, the secondary resonator B connected to the main resonator A consists of a parallel connection of the resonant pipes 12 and 12*a*. For the secondary resonator C on the outlet side, such a parallel connection for the resonant pipe 13 is not necessary.

Another possibility of forming a fixed reflection end for the main resonator A consists, in accordance with FIG. 3, in providing at the end of the resonant pipe 4 a switch valve 2*a* which is actuated in opposite direction to the switch valve 2, so that the resonant pipe 4 is connected on the one side with the hydraulic fluid supply line 5 and at the other end with the return line 6 and vice versa, and this with the corresponding resonant frequency.

The opposite arrangement in space of the parallel-connected resonant pipes 4, 4*a* and 12, 12*a* respectively is of no importance for the manner of operation of the resonators A and B formed by them. Therefore, the parallel-connected resonators 4, 4*a* and 12, 12*a* can, in each case, be arranged coaxially, the resonant pipe 4 or 12 with the pressure outlet 7 surrounding the parallel-connected resonant pipe 4*a* or 12*a* respectively, as shown in FIG. 4.

Figure 5:
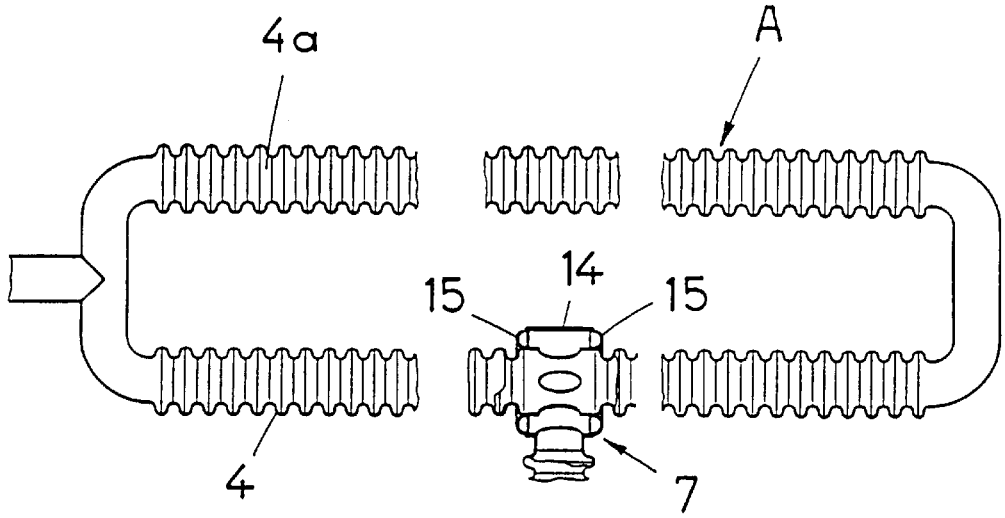
FIG. 5 is a resonator with orthotropic resonant pipes connected in parallel, shown in a simplified axial section.

In order to be able to avoid friction losses caused by local relative movements between the hydraulic fluid and the body of the resonant pipe in question, the resonant pipes can be developed orthotropic, in which case a correspondingly smaller stiffness is required in axial direction in order for the pipe body to be carried along in axial direction by the hydraulic fluid. For the obtaining of the orthotropic properties, various methods are available. One possibility is present when the resonant pipes consist of corrugated pipes, as shown in FIG. 5 for the main resonator A. Of course, in such a case, it must be seen to it that the pipe ends are held fast against displacement, which, for reasons of the clarity of the drawing, has not been shown in detail. The connection of the pressure outlet 7 must, to be sure, permit a corresponding pipe movement. For this reason, the pressure outlet 7 is formed by a connection sleeve 14 which is passed through in axially displaceable manner by the resonant pipe 4. Since the connecting sleeve 14 surrounds the resonant pipe 4 with radial clearance, the sealing is effected by ring collars 15 which permit relative displacement between pipe and sleeve.

In order to be able to utilize the advantages of the proposed resonators for the control of hydrostatic drives, suitable switch valves for the comparatively high resonant frequencies must be available. A switch valve which satisfies these requirements is shown diagrammatically in FIGS. 6 to 8. It consists essentially of a housing 16 surrounding the resonant pipe 4, within which housing a rotary piston 17 coaxial to the resonant pipe 4 is rotatably mounted, it passing through two annular chambers 18 and 19 of the housing 16 which are arranged axially one behind the other and having, in the region of both annular chambers 18, 19, passage openings 20 which form control edges and cooperate with passage openings 21 of the resonant pipe 4. In addition, a rotatable control sleeve 22 is mounted in the housing 16, it being provided with passage openings 23 and control edges 24 formed by them.

This control sleeve 22 can be displaced by a toothed ring 25. Upon rotation of the rotary piston 17 via a drive 3 in accordance with FIG. 1 in the direction of the arrow 28, the passage openings 20 in the region of the annular chamber 18 connected to the hydraulic fluid supply line 5 come into the region of the passage openings 21 of the resonant pipe 4 so that the resonant pipe 4 is connected to the hydraulic fluid supply line 5 until the control edges of the control sleeve 22 assure a closing of the passage openings 20 of the rotary piston 17 in the region of the annular chamber 18. In direction opposite to this, the passage openings 20 of the rotary piston 17 in the region of the annular chamber 19 connected to the return line 6 are opened by the corresponding control edges 24 until they come out of the region of the passage openings 21 of the resonant pipe 4 as a result of which an alternating connection of the resonant pipe 4, to the hydraulic fluid supply line 5 and to the return line 6 is assured. The switch times are in this connection determined via the rotary position of the control sleeve 22 with respect to the resonant pipe 4, while the switch frequency for a given number of passage openings distributed over the circumference depends only on the speed of rotation of the rotary piston 17. Therefore, the pulse width for a given switch frequency can be adjusted as desired by the rotary displacement of the control sleeve 22 for controlling the hydrostatic drive 1, which makes itself noticeable in a corresponding change in the operating pressure at the pressure outlets 7.

Due to the comparatively high switch frequencies, hydraulic capacitances in the form of small pressure accumulators must be provided as close as possible to the switch points. For this, there can be used in advantageous manner the annular chambers 18 and 19 into which pressure-elastic bodies can be inserted for this purposes, for instance annular hoses 27 filled with pressurized gas, for instance nitrogen, as indicated in dot-dash line in FIG. 6.

We claim:

1. A device for operating a hydrostatic drive (1) having a periodically operable switch valve (2) which connects a resonant pipe (4), connected to the hydrostatic drive (1), for formation of standing pressure waves of hydraulic fluid under resonant conditions alternately to a pressurized fluid supply line (5) and to a return line (6), wherein the resonant pipe (4) has a pressure outlet (7) in an oscillation node of the standing pressure waves, and the switch times of the switch valve (2) are controllable with constant switch frequency.

2. A device according to claim 1, wherein the resonant pipe (4) connected to the valve (2) forms a main resonator (A) having the pressure outlet (7) there being connected to the latter at least one secondary resonator (B) with a resonant pipe (12), which, in turn, has pressure outlet (7) in an oscillation node in the standing pressure waves developed in the resonant pipe (12), and the resonant pipe (4) of the main resonator (A) is connectable in parallel with an additional resonant pipe **(4*a*)**.

3. A device according to claim 2, wherein in presence of at least two secondary resonators (B, C), each of said secondary resonators is connected to the pressure outlet (7) of the preceding resonator (A, B) and, with exception of the outlet-side secondary resonator (C), comprises a parallel circuit of at least two resonant pipes **(12, 12*a*) one of which forms the pressure outlet (7)** for the connection of the following resonator (C).

4. A device according to claim 1, wherein with a parallel connection of two resonant pipes **(4, 4*a*; 12, 12*a*)**, said resonant pipes surround each other coaxially.

5. A device according to claim 1, further comprising a control device (8) is associated with the switch valve (2), the control device being for adjusting of the switch frequency to a varying resonant frequency of a resonator (A) the latter being connected directly to the valve (2).

6. A device according to claim 1, wherein the switch valve (2) is a rotary piston valve with a rotary piston (17) coaxially surrounding the resonant pipe (4), the piston passing, within a housing (16), through annular chambers (18, 19) arranged axially one behind the other and connected on the one hand with the hydraulic fluid supply line (5) and on the other hand with the return line (6), and has, in a region of said annular chamber (18, 19), passage openings (21) which form control edges and cooperate with passage openings (21) of the resonant pipe (4), a release of which passage openings is controllable by a rotatable control sleeve (22) having control edges (24) for the switch times.

7. A device according to claim 6, further comprising pressure-elastic bodies filled with a pressurized gas, disposed in the annular chambers (18, 19) of the housing (16) of the switch valve (2).

8. A device according to claim 1, wherein the body of the resonant pipe (4) is formed orthotropically with a stiffness in circumferential direction greater than in axial direction.

9. A device according to claim 8, wherein the body of the resonant pipe (4) comprises a corrugated pipe.

10. A device according to claim 1, wherein the resonant pipe (4) connected to the valve (2) forms a main resonator (A) having the pressure outlet (7), there being connected to the latter at least one secondary resonator (B) with a resonant pipe (12), which, in turn, has pressure outlet (7) in an oscillation node in the standing pressure waves developed in the resonant pipe (12), and the resonant pipe (4) of the main resonator (A) is connectable at both ends via oppositely operable switch valves **(2, 2*a*), to the pressurized fluid supply line (5) and the return line (6)**.

11. A device according to claim 10, wherein in presence of at least two secondary resonators (B, C), each of said secondary resonators is connected to the pressure outlet (7) of the preceding resonator (A, B) and, with exception of the outlet-side secondary resonator (C), comprises a parallel circuit of at least two resonant pipes **(12, 12*a*) one of which forms the pressure outlet (7)** for the connection of the following resonator (C).

12. A device according to claim 7, wherein said pressure-elastic bodies are hoses (27).

* * * * *